United States Patent [19]

Pickerrell et al.

[11] Patent Number: 4,984,312

[45] Date of Patent: Jan. 15, 1991

[54] FLUSH VALVE ADJUSTABLE ADAPTER

[75] Inventors: Daniel A. Pickerrell, Fishers; John Inch, Indianapolis, both of Ind.

[73] Assignee: Masco Corporation, Ind.

[21] Appl. No.: 343,451

[22] Filed: Apr. 26, 1989

[51] Int. Cl.[5] ..... E03D 1/00/1/34

[52] U.S. Cl. ..... 4/378; 4/415

[58] Field of Search ..... 4/378, 392, 393, 403, 4/404, 324, 326, 327, 252 R, 415; 285/331, 302, 379

[56] References Cited

U.S. PATENT DOCUMENTS

| | | | |
|---|---|---|---|
| 1,307,391 | 6/1919 | Bush | 4/378 |
| 1,638,395 | 8/1927 | Haas | 4/390 |
| 1,960,864 | 5/1934 | Brown | 4/326 |
| 2,096,306 | 10/1937 | Pieslak | 4/344 |
| 2,839,759 | 6/1958 | Martino | 4/326 |
| 2,864,095 | 12/1958 | Martino | 4/326 |
| 2,949,614 | 8/1960 | Eddowes | 4/397 |
| 3,365,216 | 1/1968 | Babylon | 285/331 |
| 3,988,785 | 11/1976 | Schoepe et al. | 4/393 |
| 4,038,707 | 8/1977 | Cass | 4/324 |
| 4,114,204 | 9/1978 | Blach | 4/324 |
| 4,122,564 | 10/1978 | Addicks et al. | 4/326 |
| 4,155,128 | 5/1979 | Dyer | 4/392 |
| 4,173,801 | 11/1979 | Bresnyan | 4/326 |
| 4,190,910 | 3/1980 | Teglund et al. | 4/421 |
| 4,454,614 | 6/1984 | Gustafsson et al. | 4/366 |
| 4,504,984 | 3/1985 | Burns | 4/326 |
| 4,660,232 | 4/1987 | Sorensen | 4/413 |
| 4,757,560 | 7/1988 | Grimstad | 4/417 |

FOREIGN PATENT DOCUMENTS

| | | | |
|---|---|---|---|
| 0813598 | 5/1989 | United Kingdom | 285/89 |

OTHER PUBLICATIONS

Delta Production flush valve (2 photographs).

*Primary Examiner*—Henry J. Recla
*Assistant Examiner*—Glenn T. Barrett
*Attorney, Agent, or Firm*—Dykema Gossett

[57] ABSTRACT

The flush valve adapter (32) has a tubular body with a lower threaded section (36) which engages a connection ring (70) permanently mounted to an upper section of jetway (72). A seal is created between the tank (10), flush valve adapter (32) and jetway (72). The adapter (32) has an upper threaded section (40) which engages a bottom threaded end (30) of a standard flush valve. A coaxially spaced sealing ring section (48) has a groove (62) that seats an O-ring (64) that seals against the bottom section (30) of the flush valve to create a seal therebetween. A lock nut (78) is also threaded onto section (30) and abuts against top shoulder (41) of the adapter (32) to lock the flush valve into place onto the adapter member (32).

10 Claims, 2 Drawing Sheets

FLUSH VALVE ADJUSTABLE ADAPTER

TECHNICAL FIELD

This invention relates to flush valves and more particularly to top mounted flush valves.

BACKGROUND OF THE INVENTION

Flush valves for toilet tanks have one or more seats for a flap valve, i.e. flapper or ball and a stand pipe which protects the toilet tank from overflowing. Most commonly for two piece toilets; namely, toilets that have a separate tank that is attached to the bowl and rim member, the flush valve has a threaded bottom end which protrudes through a bottom tank opening and a threaded nut threadably engages the threaded section from the underside of the toilet tank to secure the flush valve in place.

One piece toilets with the toilet tank being integrally formed with the bowl and rim section or preassembled together before any of the tank apparatus is installed must have the flush valve mountable from the top of the tank.

Often this is accomplished by having a fixed threaded section or mounting ring mounted under the toilet tank outlet. The flush valve can have a rotatable threaded ring with internal ribs for engagement with a specialized tool for rotation therewith which when rotated tightens the stand pipe and valve seat against the bottom of the tank with a gasket interposed therebetween.

The problem with the previous mounting for one piece toilet tanks is that the valve seat has no height adjustment. Today's low water consumption toilets need a certain minimum amount of water for an adequate flush. A flush valve set too high would lessen the amount of water below the needed minimum. A flush valve set too low defeats the purpose of a low water consumption toilet and allows for waste of water. A height adjustment for the flush valve is necessary in low water consumption toilets. A second problem with present flush valves for one piece toilets is that a specialized tool is needed to rotate the inner ring for tightening the flush valve assembly onto the toilet tank.

What is needed with today's low consumption toilet in which a precise amount of water is needed to obtain an adequate flush is a flush valve adapter. The flush valve adapter can be threaded onto the threaded section below the toilet tank and has an upper end connected to a flush valve originally made for a two piece toilet tank which does not have the special rotating ring therein.

What is needed is a flush valve adapter that allows the height of the flush valve to be adjusted to provide for the precise amount of water needed for adequate flushes in low water consumption toilet tanks that can mount a flush valve with no needed special tools.

SUMMARY OF THE INVENTION

In accordance with one embodiment of the invention, an adapter for a flush valve is a tubular member for the first threaded lower end and a second threaded upper end. The first threaded lower end is exteriorly threaded and the sides threadably engage a threaded annular connection section of the jetway of the bowl about and below the toilet tank outlet opening. The tubular member has a radially outwardly extending shoulder for seating a sealing gasket between the shoulder, the tank, and the threaded annular connection section of the jetway about the outlet opening of the tank. The tubular members threaded upper end is threaded to engage a threaded bottom end of a flush valve. A sealing ring is interposed between the flush valve and tubular body member.

The tubular member has an upper end section with a polygonally shaped exterior wall for engagement to an appropriately sized wrench.

Preferably a seal between the flush valve and the adapter includes a coaxial tubular section which is coaxial with the threaded upper section and has an annular groove that seats an annular sealing member and is sized to abut against the flush valve also. A lock ring is threadably engaged to the threaded section of the flush valve and can be rotated to lock against the top end of the adapter after the flush valve is threaded to the desired height onto the flush valve adapter. The tubular body has an upper end with the shoulder abutable against the locking nut.

The adapter provides for use of a flush valve without any specialized rotatable ring therein. The flush valve adapter can be tightened onto the toilet tank with an appropriate size wrench without any other special tooling. Furthermore, the flush valve adapter allows the flush valve to be threaded onto the adapter a desired amount such that the height of the flush valve seat can be adjusted. The flush valve can be securely fixed by a lock nut. These advantages can all be incorporated into a one piece toilet.

BRIEF DESCRIPTION OF THE DRAWINGS

Reference now will be made to the accompanying drawings in which.

DETAILED DESCRIPTION OF THE PREFERRED EMBODIMENT

Figure 1:
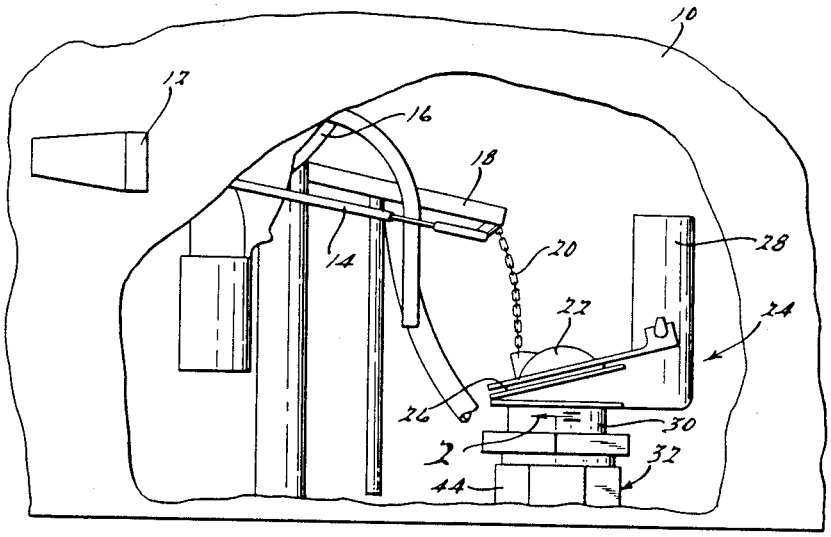
FIG. 1 is a front elevational and fragmentary view of a toilet tank incorporating a flush valve according to the invention.
Figure 2:
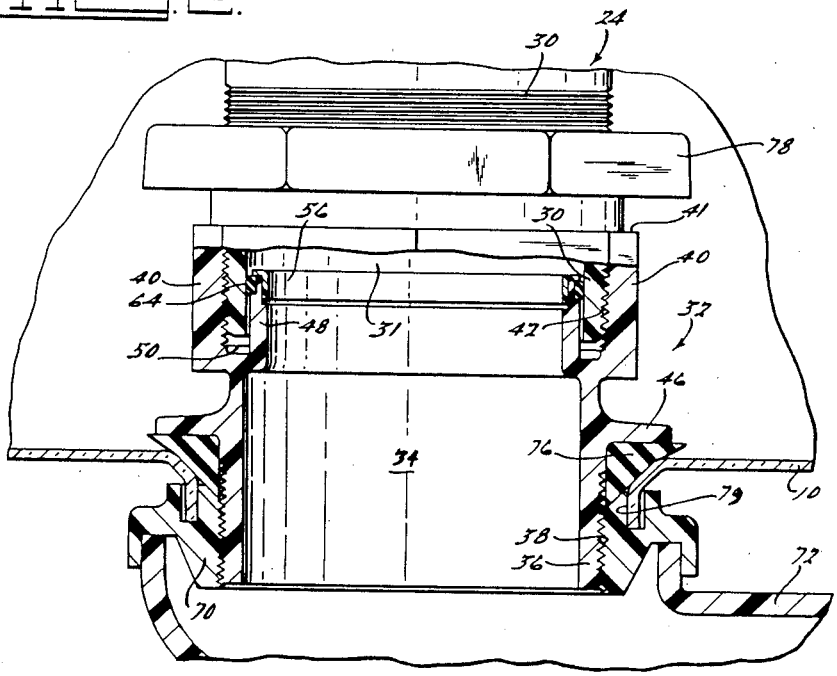
FIG. 2 is an enlarged partially segmented view of the flush valve adapter installed in the toilet tank shown in FIG. 1.

Referring to FIG. 1, the toilet tank 10 has an operable handle 12 with a trip lever 14 connected to a fill valve 16, diverter valve lever 18, and a chain 20 which connects to a flapper 22 which is pivotally mounted on flush valve 24. Flush valve 24 has a valve seat 26 and a stand pipe 28. A bottom threaded section 30 of flush valve 24 is connected to a flush valve adapter 32 as clearly shown in FIG. 2.

Figure 3:
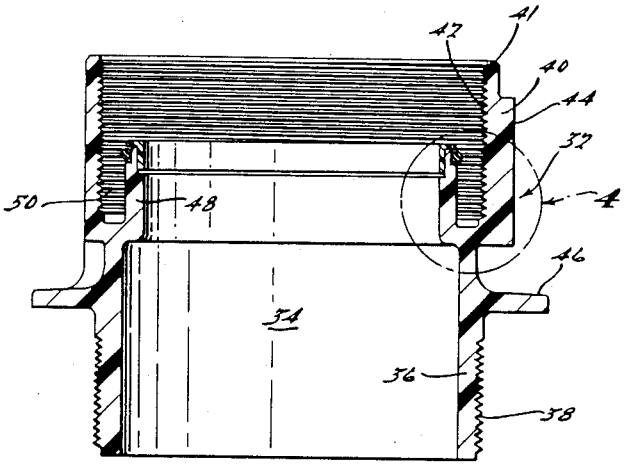
FIG. 3 is an enlarged sectional view of the adapter shown in FIG. 2.

Referring to FIG. 3 the flush valve adapter 32 is basically tubular with an internal passage 34 extending therethrough. The bottom section 36 has external threads 38. Upper section 40 has internal threads 42. The top of section 40 forms a top shoulder 41. The exterior wall 44 of section 40 is polygonal in shape and adapted to receive an appropriately sized wrench.

A radially outwardly extending flange 46 is formed between the sections 36 and 40. A coaxially mounted interior upwardly extending portion 48 is generally parallel to and spaced from section 40 to form a gap 50 therebetween.

Figure 4:
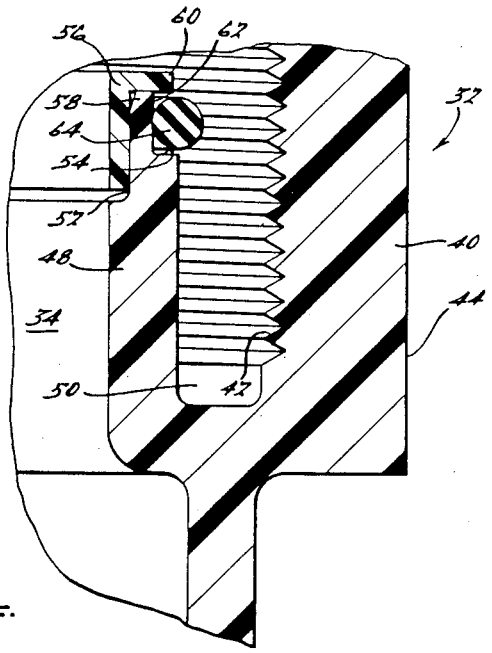
FIG. 4 is an enlarged fragmentary view of the area bound by cutaway line 4 shown in FIG. 3.

As shown in FIG. 4, section 48 has an upper interior notch 52 and an exterior notch 54. An annular ring 56 having an L-shaped cross-section fits within notch 52 and is sonically welded or glued into the end section 58 of section 48. The distal end 60 of the L extends over notch 54 to form a groove 62 which receives an elastomeric O-ring 64.

Referring back to FIG. 2, the threaded section 36 has its threads 38 engage interiorly threaded connection ring 70 which is permanently mounted onto the jetway section 72 and the interior tank 10 of a one piece toilet. The connection ring 70 can be permanently affixed under the tank 10 to the jetway section 72 before adapter 32 is installed. Installation of the adapter is accomplished merely by inserting the adapter along with the gasket ring 76 mounted about the threaded section, 36 to abut flange 46 into the bottom outlet 79 of toilet tank 10 and threaded into place until the shoulder 46 compresses gasket 76 onto the toilet tank 10 about the opening 79.

The adapter 32 can then have upper section 40 receive flush valve 24 that has its bottom threaded section 30 engage the threads 42 and fits in gap 50 between sections 48 and 40. The O-ring 64 abuts an interior wall 31 of section 30 to provide a seal therebetween. The flush valve 24 is threaded into section 40 until the desired height of valve seat 26 is achieved. At this point a lock nut 78 which is prethreaded onto section 30 is then threaded downwardly until it abuts shoulder 41 of upper section 40 and locks the flush valve 24 securely in place.

As can be seen, the flush valve 24 can be threaded into section 40 and its height can be adjusted by rotating one thread counterclockwise or be adjusted downward by rotating one thread clockwise. If further adjustment is needed, an additional turn clockwise to lower the flush valve or an additional turn counterclockwise to raise the flush valve can be accomplished. The flush valve adapter threads 42 and seal 64 allow for at least four rotations of adjustability which provides for almost ⅜" of adjustment of the height of the flush valve seat 26 which determines the amount of water in tank 10 that actually is used during each flush. The flush valve adapter is specifically desirable for low water consumption toilets in which fine tuning of the flush valve seat 26 height is important to precisely determine the amount of water used during each flush. In addition, the adapter 32 also raises the flush valve seat 26 within the tank to use water toward the upper end of tank 10 which provides for greater water pressure passing to the jetway section 72 and lets the water within the bottom section of the tank remain unusable and therefore not flushable and cuts down on usage of the water that has less waterhead pressure.

Furthermore, the flush valve adapter allows for a top mounting of the flush valve and accommodates the use of a standard flush valve 24 which normally can only be mounted onto a two piece toilet tank. The flush valve adapter by accommodating a standard flush valve provides an economical method of having a flush valve for a one piece toilet.

Variations and modifications of the invention are contemplated without departing from its spirit as defined in the appended claims.

The embodiment in which an exclusive property or privilege is claimed is defined as follows:

1. An adapter for a flush valve in a toilet tank, said adapter characterized by:

a tubular body member having a first threaded lower end and second threaded upper end;

said lower end being exteriorly threaded and sized to threadably engage a threaded annular connection section positioned under said toilet tank;

a radially outwardly extending shoulder between said upper and lower ends for seating a sealing gasket between said shoulder and said toilet tank;

said upper end being threaded along a cylindrical wall to threadably engage a threaded section of a tubular bottom end of a flush valve;

sealing means for sealing said connection between said adapter and said tubular bottom end of said flush valve, including a tubular wall coaxially positioned with, and facing, said wall of said upper end, said wall of said upper end and said tubular wall defining generally parallel spaced cylindrical surfaces, said tubular wall including a groove, facing said cylindrical wall of said upper end said groove receiving a sealing ring.

2. An adapter as defined in claim 1 further characterized by:

said upper end having a polygonally adapted exterior wall for engagement to a wrench means for threadably engaging said lower end to said annular connection section.

3. A flush valve and toilet tank assembly characterized by:

a toilet tank having an outlet at a bottom;

said outlet having an annular internally threaded section;

a tubular body member having an externally threaded lower end engaged to said annular internally threaded section of said outlet;

said tubular body member having a tubular threaded upper end;

a flush valve having a tubular bottom end complimentarily threaded to engage said upper end of said tubular body at any one of a plurality of different heights;

first seal means interposed between said lower end and said tank about said outlet;

locking means being movable to lock said flush valve onto said tubular body member after said flush valve has been moved to any one of a plurality of vertical heights.

4. An assembly as defined in claim 3 further characterized by:

said locking means including a lock nut threadably engaged to said flush valve and abutable against said tubular body;

said tubular body having an upper shoulder abutable against said lock nut such that when said lock nut is threaded downwardly and abuts against said tubular body said flush valve is frictionally affixed against rotation with respect to said tubular member.

5. An assembly as defined in claim 3, further characterized by a sealing ring received in a groove in said upper end and in contact with said bottom end, said sealing ring remaining in said groove, and in sealing contact with said bottom end, as said flush valve is moved to different operative heights.

6. An adapter for a flush valve for a toilet tank, said adapter characterized by:

a tubular body member having an externally threaded lower end and an interiorly threaded upper end;

said lower end sized to threadably engage a threaded annular connection section below and about an outlet of said toilet tank;

an annular sealing ring member seated about said lower end;

said tubular body member having a radially outwardly extending annular shoulder between said lower end and said upper end, said annular shoulder being abutable against said sealing ring member and axially positioned such that when said lower end engages said annular connection section, said shoulder compresses said sealing ring member against a bottom of said toilet tank about said outlet;

said upper end sized to threadably engage a threaded tubular bottom end of a flush valve;

a tubular wall coaxially positioned with and facing threads of said upper end;

said tubular wall having an annular groove therein facing said threads of said upper end;

a second sealing ring being of elastomeric material fitting in said groove;

said wall and said upper end spaced apart to define an annular space for adjustably and sealingly receiving said bottom end of said flush valve;

said upper end having an end shoulder.

7. An adapter as recited in claim 6, wherein an inner periphery of said upper end and an outer periphery of said tubular wall define generally parallel spaced cylindrical surfaces.

8. A method of adjusting the height of a flush valve in a toilet assembly comprising the steps of:

(1) mounting an adapter member in the toilet tank;

(2) attaching a flush valve to the adapter, and adjusting the height of the flush valve relative to the adapter to a desire height, selected from a plurality of operative heights, to control the amount of water sent to a toilet bowl when the flush valve is opened, a seal is received in a groove in the adapter, the seal remaining in sealing contact with the flush valve and remaining received in the adapter as the height of the flush valve is adjusted relative to the adapter.

9. A method as recited in claim 8, further wherein the adapter member and the flush valve being threadably connected, and the height of the flush valve being adjusted by turning it either clockwise or counterclockwise relative to the adapter.

10. A method as recited in claim 9, further comprising the steps of:

(3) locking the flush valve to the upper end of the adapter after it has been moved to the desired height, by turning a lock nut until it abuts the flush valve and locks it onto the adapter.

* * * * *